US010850751B2

(12) United States Patent
Wipfler et al.

(10) Patent No.: US 10,850,751 B2
(45) Date of Patent: Dec. 1, 2020

(54) BEARING BLOCK ASSEMBLY

(71) Applicant: Voith Patent GmbH, Heidenheim (DE)

(72) Inventors: Mathias Wipfler, Betheln (DE); Renato Guimarães Aquino de Oliveira, Sao Paulo (BR)

(73) Assignee: Voith Patent GmbH, Heidenheim (DE)

( * ) Notice: Subject to any disclaimer, the term of this patent is extended or adjusted under 35 U.S.C. 154(b) by 0 days.

(21) Appl. No.: 16/170,554

(22) Filed: Oct. 25, 2018

(65) Prior Publication Data

US 2019/0061790 A1 Feb. 28, 2019

Related U.S. Application Data

(63) Continuation of application No. PCT/EP2017/058051, filed on Apr. 5, 2017.

(30) Foreign Application Priority Data

Apr. 25, 2016 (DE) ..... 10 2016 206 989

(51) Int. Cl.
*B61G 9/24* (2006.01)
*B61G 9/10* (2006.01)
*B61G 11/16* (2006.01)

(52) U.S. Cl.
CPC ..... *B61G 9/24* (2013.01); *B61G 9/10* (2013.01); *B61G 11/16* (2013.01)

(58) Field of Classification Search
CPC . B61G 9/10; B61G 9/24; B61G 11/16; B61G 9/00; B61G 9/04; B61G 9/06; B61G 9/14; B61G 9/20; B61G 9/22; B61G 7/12
See application file for complete search history.

(56) References Cited

U.S. PATENT DOCUMENTS

| | | | | |
|---|---|---|---|---|
| 8,960,464 | B2 | 2/2015 | Peckham | |
| 2009/0008963 | A1* | 1/2009 | Lindner | B61G 7/10 296/187.03 |
| 2012/0199545 | A1* | 8/2012 | Peckham | B61G 9/10 213/65 |

FOREIGN PATENT DOCUMENTS

| | | | |
|---|---|---|---|
| EP | 1 719 684 | A1 | 11/2006 |
| EP | 2 700 556 | A1 | 2/2014 |
| WO | 2013/134920 | A1 | 9/2013 |

OTHER PUBLICATIONS

Notice of Transmission of the International Research Report and the Written Notice Issued the International Searching Authority or Declaration dated Jul. 7, 2017 for International Application No. PCT/EP2017/058051 (14 pages).

* cited by examiner

*Primary Examiner* — Jason C Smith
(74) *Attorney, Agent, or Firm* — Taylor IP, P.C.

(57) ABSTRACT

The invention relates to a bearing block assembly for hinging of a coupling rod to a carriage body. The bearing block assembly includes a bearing shell unit and a bearing block with a flange for connecting the bearing block assembly to the carriage body and has an open bearing shell receiving region for at least partial reception of the bearing shell unit. The bearing block assembly has at least one guide extending in a longitudinal direction over at least a section of the extension of the bearing block. The bearing shell unit connects to the bearing block via at least one tear-off element and/or at least one shear-off element and is movably guided on the at least one guide in a longitudinal direction relative to same when the connecting element is actuated, thereby releasing the connection between the bearing shell unit and the bearing block.

16 Claims, 4 Drawing Sheets

BEARING BLOCK ASSEMBLY

CROSS REFERENCE TO RELATED APPLICATIONS

This is a continuation of PCT application No. PCT/EP2017/058051, entitled "BEARING BLOCK ASSEMBLY", filed Apr. 5, 2017, which is incorporated herein by reference.

BACKGROUND OF THE INVENTION

1. Field of the Invention

The invention relates to a bearing block assembly for hinging of a coupling rod to a carriage body of a track guided vehicle, in particular a rail vehicle.

2. Description of the Related Art

Bearing block assemblies in the rail vehicle technology generally serve to connect a coupling rod pivotably in a horizontal plane with the carriage body of a rail guided vehicle. In order for the coupling rod to swivel relative to the carriage body, necessary for example in a multiple-unit train when traveling along curves, the hinging that is provided via the bearing block is generally designed in such a way that at least horizontal and vertical movements as well as axial rotation of the coupling rod relative to the carriage body is made possible.

It is moreover known that a coupling rod supported rigidly by a bearing block can lead to damage of the carriage or respectively to damage of the coupling assembly itself by the shocks and vibrations that occur, for example, during a coupling procedure or during braking. To avoid such damage, it is necessary to limit transfer of such shocks, vibrations and the like as much as possible. For the absorption of such shocks, a push/pull device with flexible damping devices is provided in the power train that is transmitted via the coupling rod. Such a push/pull device is often integrated in the hinge of the coupling rod on the carriage body, in other words, in the bearing block provided for this purpose. This push/pull device is designed to transmit tensile and compressive forces up to a certain dimension in a flexible manner via the bearing block into the vehicle undercarriage. The objective is to absorb the energy with an elastic deformation of the damping element associated with the push/pull device, thereby preventing excessive strain on the bearing block and thus on the vehicle undercarriage.

Moreover, it is already known for example from documents EP 1719 684 A1, WO 2013/134920 A1 and EP 2 700 556 B1, that to avoid introducing large predefined critical impact forces via the bearing block arrangement into the carriage body and thereby prevent destruction of the bearing block surroundings, the coupling rod that is coupled with the bearing block from the power train to the carriage body is removed. This removal is accomplished through severing the connection to the bearing block via shear-off elements, or in the embodiment described in EP 2 700 556 B1, disconnection can occur via tear-off elements. Depending on the design, the coupling rod can then, together with the connected components be pushed through the bearing block. However, after actuation of the shear-off or tear-off elements, twisting or canting of the coupling rod end with the connected bearing components in the bearing block cannot be ruled out. The individual components of the bearing are only joined together during assembly, so that when disengaging the connection their composite action is also eliminated, causing the individual components to drop down after sliding from the bearing environment. The design described in EP 2 700 556 B1 with connection via a flange that is aligned in a vertical plane and provided by the individual bearing shells, is relatively complex and is only suitable in particular for bearing block designs that are closed in a circumferential direction around the longitudinal axle.

What is needed in the art is a bearing block assembly so that the cited disadvantages may be avoided.

Also needed in the art is a bearing block assembly that has a simple and compact construction at an effective price.

SUMMARY OF THE INVENTION

The present invention provide a bearing block assembly for hinging a coupling rod to a carriage body of a track guided vehicle, in particular a rail vehicle, including the following:

- a flange for connecting the bearing block assembly to the carriage body; and
- a bearing shell unit, with two retainers being arranged in horizontal planes that are vertically offset for accommodating a vertically progressing common pivot pin or for accommodating respectively one vertically progressing rotary pin that is allocated to the respective retainer;

wherein the bearing shell unit may be connected at least indirectly with the flange,

- a bearing block that includes the flange for connecting the bearing block assembly with the carriage body or forms, and having an open bearing shell receiving region in particular at least in a longitudinal direction for the at least partial reception of the bearing shell unit;
- at least one guide extending in longitudinal direction over at least a section of the extension of the bearing block; and
- the bearing shell unit may be connected to the bearing block via at least one tear-off element and/or at least one shear-off element and is movably guided on the at least one guide on the bearing block in longitudinal direction relative to same when the at least one tear-off element and/or the at least one shear-off element is actuated, thereby releasing the connection between the bearing shell unit and the bearing block.

In an exemplary embodiment, the bearing shell unit may be connected with the bearing block via at least one tear-off element that is aligned in a longitudinal direction of the bearing block and movably guided on the at least one guide of the bearing block in a longitudinal direction relative to same when the at least one tear-off element and/or the at least one shear-off element is actuated, thereby releasing the connection between the bearing shell unit and the bearing block.

The tear-off element is generally understood to be a connecting element which connects the bearing shell unit with the bearing block, directly or indirectly, until the occurrence of a predeterminable critical impact force upon the bearing shell unit and which, on exceeding the predeterminable critical impact force loses its connectivity function.

A shear-off element is generally understood to be a connecting element which connects the bearing shell unit with the bearing block, directly or indirectly, until the occurrence of a predeterminable critical impact force upon the bearing shell unit and which, on exceeding the predeterminable critical impact force loses its connectivity function due to shearing off.

Another exemplary embodiment according to the invention offers the advantage that a separation may occur between the actual bearing function of the coupling rod in the bearing shell unit upon the introduction of the forces into the bearing block. On actuation of the tear-off elements and disengagement of the connection, the coupling rod in the bearing shell unit that is hinged together with same can be removed from the power train to the carriage body and, due to the guide element will not immediately drop off the carriage body, but due to the connection of the bearing block assembly with the carriage body will be guided in defined longitudinal direction, thereby avoiding canting in the bearing block. The bearing arrangement of the coupling rod on the bearing shell unit can be simplified considerably by use of shear-off devices in the region of the retainer for the pivot pin or rotary pin since this safety function is relocated from the region of the retainers.

In another exemplary embodiment, the flange attached to or formed by the bearing block has one or a number of flange regions providing flange surfaces arranged at least partially in a horizontal plane and extending in a longitudinal direction for connecting with a complimentary contact surface on the carriage body, in particular contact surfaces located on the underside of the carriage body. This design of a horizontal interface permits the use in applications with required hinging from below on the undercarriage of a carriage body and at the same time assurance of a secure guidance of the bearing arrangement of the coupling rod in the case of an actuation of the tear-off elements.

Due to the separation of functions for individual regions on the bearing block and the bearing shell unit, these components can be constructed relatively simple and compact as separate components or as a single component. The single component design of the bearing shell unit provides that even after actuation of the tear-off elements, the bearing shell unit remains firmly connected with the coupling rod and is not thrown off.

As a single component design, the bearing block has a half-shell region which surrounds the bearing shell receiving region that is open at least in longitudinal direction for at least partial accommodation of the bearing shell unit.

The bearing block and bearing shell component may be manufactured as a cast component.

For the connection with the bearing block, the bearing shell unit may include at least one connectivity region. For guidance on the bearing block, in the case of an actuation, the bearing shell unit may include at least one guidance region or one guide element for interaction with the one guide that extends in a longitudinal direction of the bearing block. The single connecting region provided on the bearing shell unit and/or the single guidance region or the guide element may be arranged respectively offset relative to a retainer, preferably offset at an angle of 30° to 90° relative to a single retainer viewed in circumferential direction of the bearing shell unit around the axis of rotation. This exemplary embodiment may allow for simply designed bearing shell units with clearly defined function areas.

Sections of individual connecting region provided on the bearing shell unit and the individual guide region may be formed integrally which results in a further simplification of the design of the bearing shell unit and the possibility of providing especially compact bearing block assemblies in regard to space requirements.

A multitude of configurations are available in regard to the individual guide on the bearing block. In the simplest form it includes one or several guide surfaces taken from the following group of guide surfaces, provided integrally on the bearing block:

- a guide surface limiting an upward movement of the bearing shell unit in vertical direction with a directional component perpendicular to the longitudinal direction;
- a guide surface limiting a downward movement of the bearing shell unit in vertical direction with a directional component perpendicular to the longitudinal direction; and/or
- a guide surface limiting a movement in width direction of the bearing shell unit in horizontal direction with a directional component perpendicular to the longitudinal direction of the bearing block.

The guide surfaces may prevent breaking loose of the bearing shell unit in the respectively specified directions, whereby two in combination prevent twisting of same inside the bearing block by simultaneously providing defined guidance of same.

In an exemplary embodiment, the guide system consisting of a guide on the bearing block and a guidance region or guide element on the bearing shell unit formed by a positive connection between bearing block and bearing shell unit with a clearance fit and a degree of freedom in a longitudinal direction. The guide system can be selected from the group of connections listed below:

- a tongue and groove joint;
- a profile connection, in particular dovetail connection; and
- a rail and carriage connection In another exemplary embodiment, the length of the guide on the bearing block and of the guide element or respectively the guide region on the bearing shell unit is designed in such a way that after actuation of the tear-off elements and maximum permissible shifting of the bearing shell unit relative to the bearing block in longitudinal direction, the bearing shell unit is still free from a complete separation from the bearing block in the sense of guidance on same, whereby however no forces are transmitted into the carriage body via same. In particular, when attached to the undercarriage, this reliably prevents dropping of the bearing shell unit with connected coupling.

For the connection between the bearing shell unit and the bearing block, bracing may be provided across the at least one tear-off element, in particular in a tensile force direction. In a concentration of functions, the transmission of force from the bearing shell unit to the bearing block via the tear-off elements is ensured and thereby also under tensile stress with the same connecting elements.

According to yet another exemplary embodiment, the bearing block has a tension stop that is integral or connected with same for support of the bearing shell unit when it is under tensile stress and wherein the bearing shell unit is braced relative to the tension stop via the tear-off elements with tear-off bolts that may be secured by nuts.

The tear-off elements may be provided in the form of detachable or non-detachable connecting elements. The tear-off elements can moreover be based on form-fit or frictional connection. For example, the use of tear-off bolts or rivets is conceivable. Tear-off elements in the embodiment of tear-off bolts may also be used. These may offer a precise configuration in individual cases.

If the bearing shell unit and the bearing block are connected with each other via shear-off elements, these can also be provided by detachable or non-detachable connecting elements. The shear-off elements can moreover be based on form-fit or friction connection in regard to the transmission of force. The use of bolts or rivets is for example conceivable. These are arranged in such a way that upon an impact of force with the main directional component in a longitudinal direction of the coupling rod they are actuated.

In yet another exemplary embodiment with tear-off elements, the connecting region and the guidance region on the bearing shell unit may be formed by a solid profile element that is integral with the bearing shell unit and extends in a longitudinal direction, wherein said solid profile element has guide surfaces on its outside circumference for guiding on the guideway of the bearing block and wherein the tear-off elements extend and the bearing shell unit is arranged in a connecting manner with the bearing block in the region of the full profile elements. This may provide that the tear-off elements are aligned in the primary direction of the force and that their alignment coincides with the guidance direction of the bearing shell in the event of an actuation, so that canting of the bearing shell unit and the bearing block are reliably avoided.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention and such exemplifications are not to be construed as limiting the scope of the invention in any manner.

DETAILED DESCRIPTION OF THE INVENTION

Figure 1A:
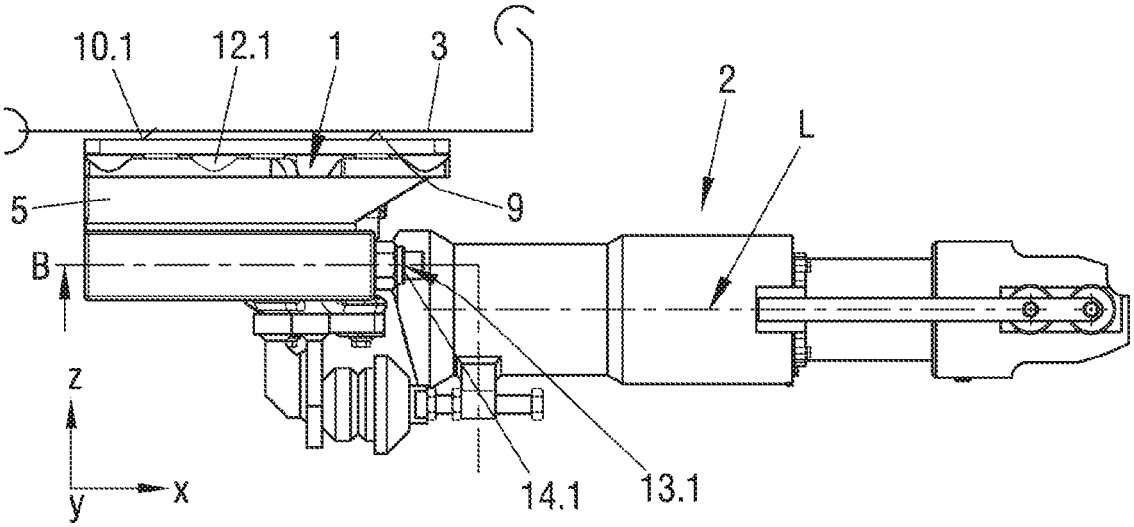
FIG. 1*a* shows an embodiment of a bearing block assembly.
Figure 1B:
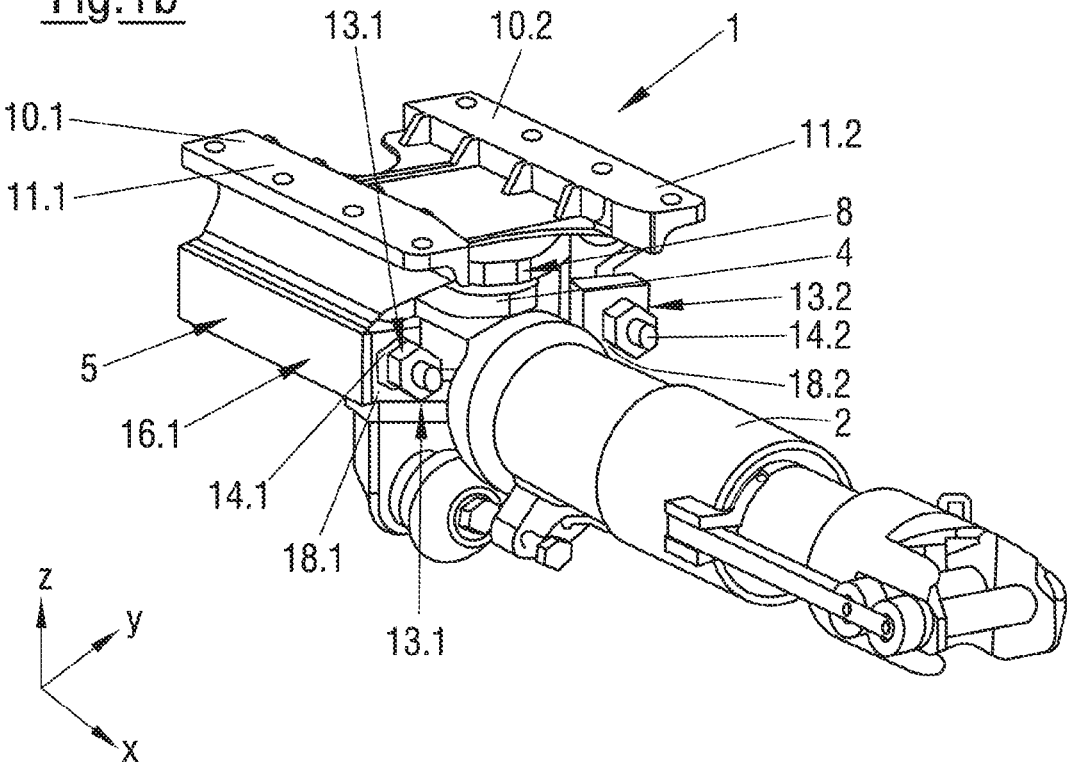
FIG. 1*b* shows a perspective view of the embodiment shown in FIG. 1*a;*
Figure 1C:
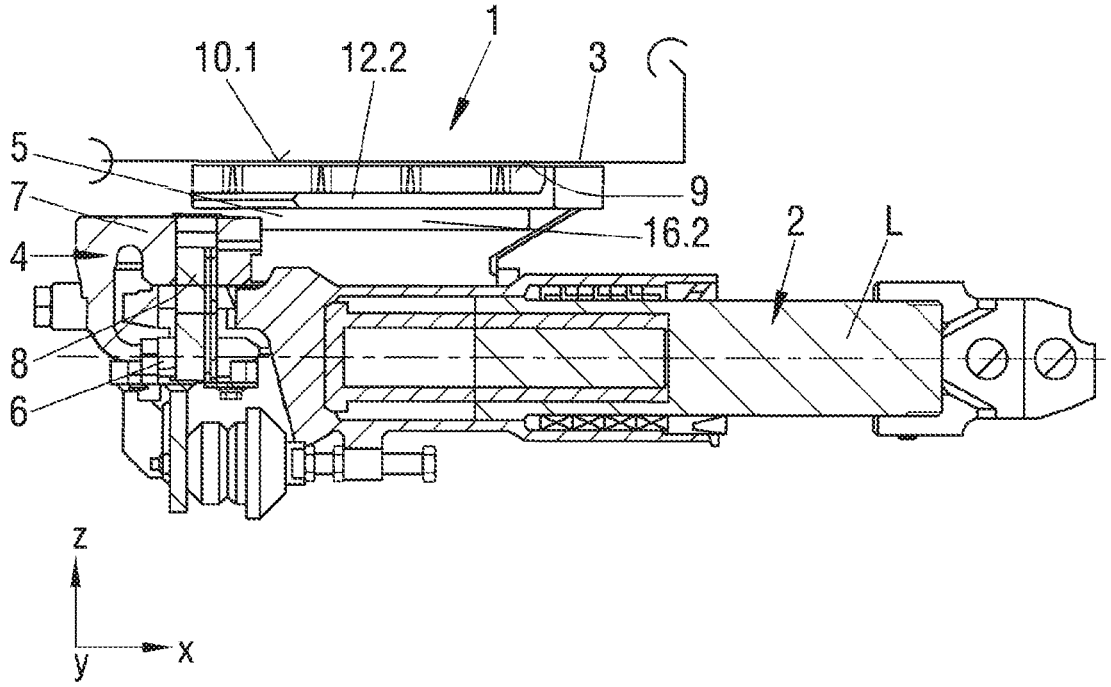
FIG. 1*c* shows a cross section view through the embodiment shown in FIG. 1*a;*
Figure 2:
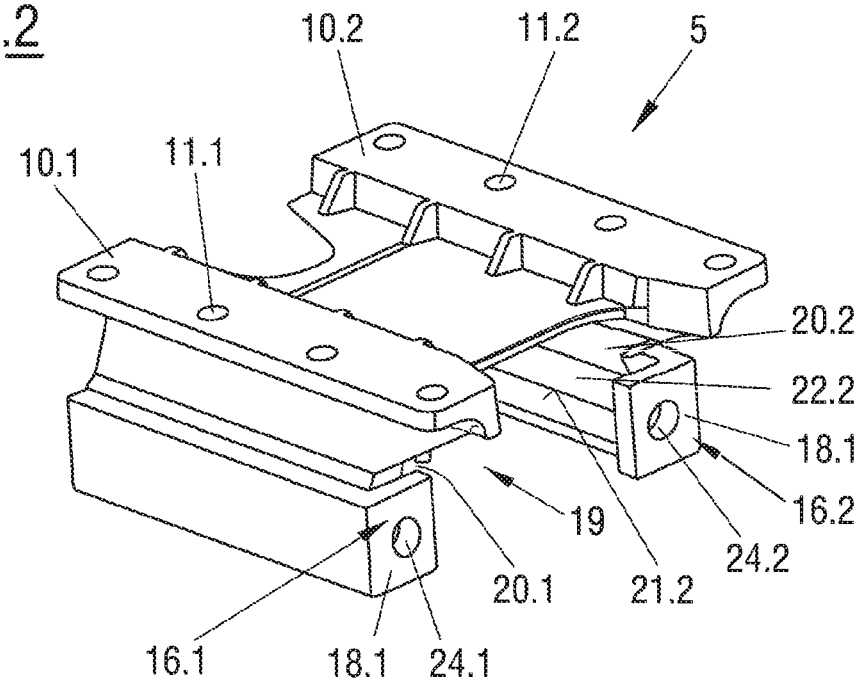
FIG. 2 shows a perspective view of an embodiment of a bearing block.
Figure 3:
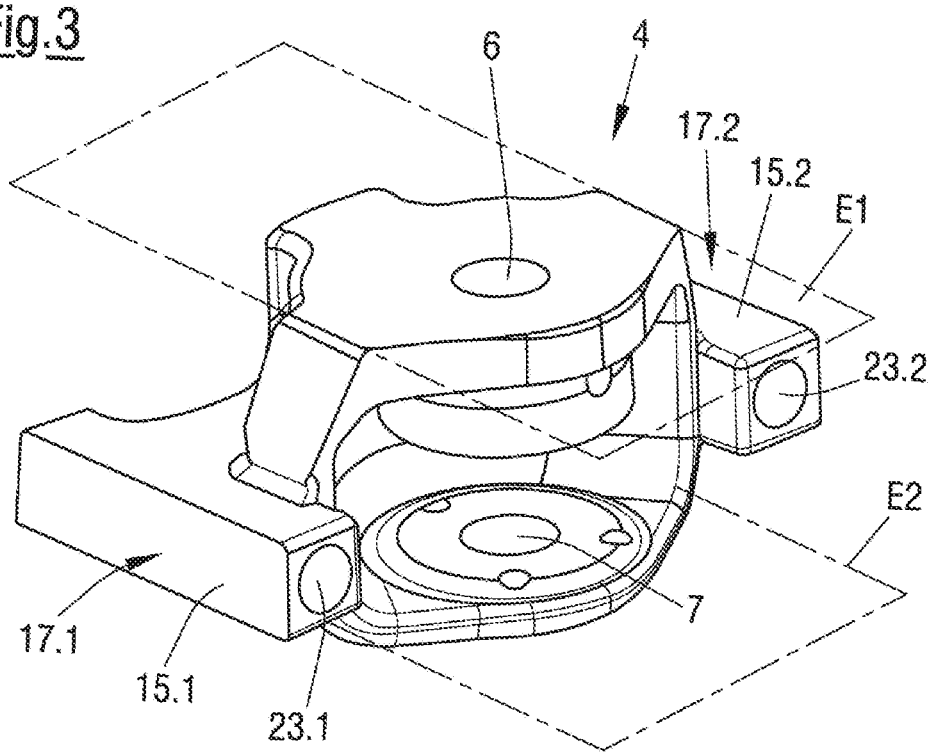
FIG. 3 shows a perspective view of an embodiment of a bearing shell.
Figure 4A:
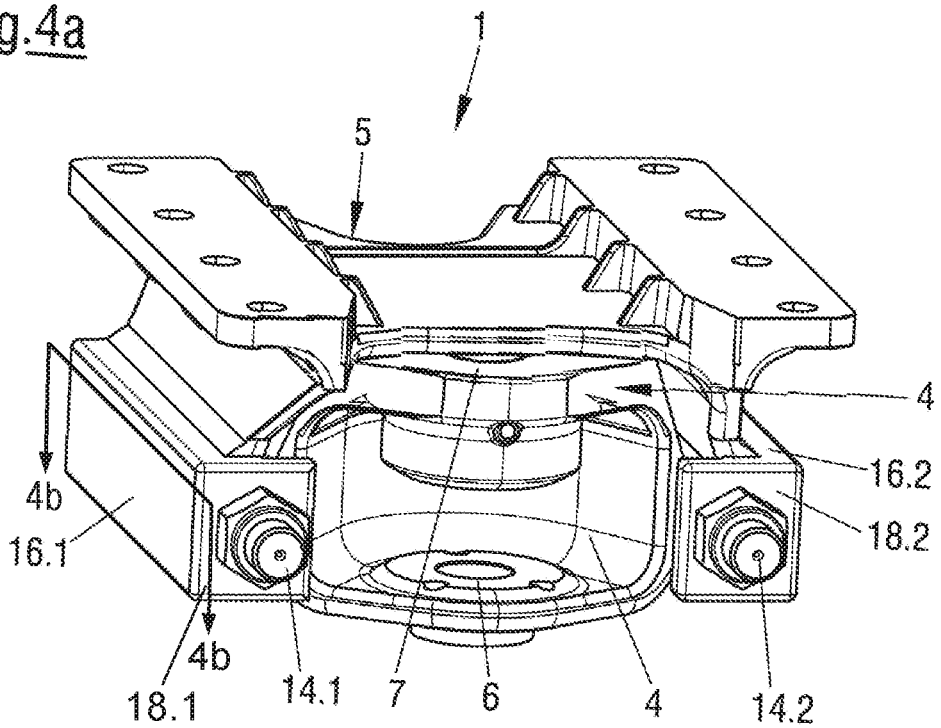
FIG. 4*a* shows the embodiment shown in FIGS. 1*a*, 1*b* without the arrangement of a pivot bolt or rotary bolt in the retainer of the bearing shell unit.

Referring now to the drawings, and more particularly to FIGS. 1*a* and 1*b* there are shown illustrations of the basic construction and basic configuration of a bearing block assembly 1 according to the invention for hinging of a coupling rod 2 of a coupling to a carriage body 3 (that is merely indicated here) of a track guided vehicle, in particular a rail vehicle, showing various views in neutral positions of coupling rod 2, in other words in the non-deflected position. FIG. 1*a* clarifies the installation position in a longitudinal direction, in which the neutral position of the coupling coincides with a longitudinal axis L of coupling rod 2. For clarification of the individual directions an exemplary coordinate is provided. The X-axis coincides with the longitudinal direction of the coupling, the Y-axis coincides with the lateral direction and thereby with the extension of bearing block assembly 1 transversely to longitudinal axis L; and the Z-direction describes the extension in vertical direction, in other words perpendicular to longitudinal axis L in a vertical or height direction. In regard to the bearing block assembly, the X-direction is consistent with the extension of bearing block 1 assembly in a longitudinal direction, the Y-axis is consistent with the extension of bearing block assembly 1 in a width direction and the Z-direction is consistent with the extension in a vertical direction. FIG. 1*c* clarifies the positions of the individual components of bearing block assembly 1 in the event of an overload after actuation of the tear-off element in an illustration of a sectional plane that is described by longitudinal axis L and a vertical line to same. FIGS. 2 and 3 respectively are perspective views showing the individual components of bearing block 2 and bearing shell unit 4. FIG. 4*a* illustrates the bearing block assembly without a pivot pin or a rotary pin. FIG. 4*c* again shows the individual components in an exploded view depiction. All FIGS. 1 to 4 relate to an exemplary embodiment of bearing block assembly 1.

FIG. 1*a* clarifies a view onto bearing block assembly 1 with coupling rod 2 in an installation position in the neutral position with a view onto longitudinal axis L. FIG. 1*b* illustrates a view of the embodiment according to FIG. 1*a* in the perspective view. FIG. 1*c* clarifies the location allocation relative to one another of the components of bearing block assembly 1 and of the clutch in the event of an overload for a design according to FIG. 1*a*.

Bearing block assembly 1 includes a bearing block 5 for stationary mounting to a carriage body 3 that is indicated in FIG. 1*a*, and a bearing shell unit 4 that connected with bearing block 5 via tear-off elements 14.1, 14.2. Due to the depiction of the complete assembly, FIGS. 1*a* to 1*c* do not show all components. However, the individual components provided in them are illustrated in FIGS. 2 and 3 respectively. The following description therefore also refers to these figures. Bearing block 5 and bearing shell unit 4 are designed essentially symmetrically in regard to a vertical plane that is described by an axis aligned in a longitudinal direction and a perpendicular line thereto in a vertical direction.

Bearing shell unit 4 includes a first retainer 6 located in a first horizontal plane E1 and a second retainer 7 located in a second plane E2 that is arranged vertically offset to first plane E1 for receiving a vertically extending common pivot pin 8 or for receiving, not illustrated here, a respectively vertically extending rotary pin allocated to respective retainer 6, 7. Retainers 6, 7 are arranged in bearing shells having vertical planes E1 and E2 offset to one another. Retainers 6, 7 may be connected with one another and designed integral with the bearing shells. In other words, bearing shell unit 4 may be an integral or respectively single component. Coupling rod 2 may be mounted in retainers 6, 7 of bearing shell unit 4, either directly or via intermediate push/pull devices above pivot pins 8 or the rotary pins. Mounting occurs pivotably in horizontal direction around the longitudinal axis of pivot pin 8 and in a vertical direction around a longitudinal axis L, coinciding in a neutral position of the coupling rod with the longitudinal axis of the coupling rod. The connection of coupling rod 2 with bearing shell unit 4 can occur via a common pin that is rotatably mounted in retainers 6, 7 and which is guided through a bearing-side bearing eye of coupling rod 2, whereby a spherical bearing is provided between coupling rod 2 and bolt 8 or bolt 8 and the retainer.

Bearing block 5 and bearing shell unit 4 may be designed symmetrically in regard to a vertical plane of symmetry that is described by the longitudinal direction and a perpendicular line to same in a vertical direction.

Bearing block 5 may include a flange for connecting bearing block assembly 1 with carriage body 3. In an exemplary embodiment for installation on the underside of carriage body 3, the bearing block 5 is arranged in a horizontal plane or respectively forms horizontal flange regions with relevant flange surfaces, in this case two flange surfaces 10.1, 10.2, for interaction with complementary contact surfaces 9 provided on the carriage body 3. Bearing block 5 may be immovably connected with carriage body 3. The connection, herein connections 12.1, 12.2, of the flange regions with flange surfaces 10.1, 10.2 between carriage body 3 and bearing block 5 occurs either detachably with a positive connection in the form of a screw connection. Non-detachable connections in the form of rivet connections are also conceivable. FIG. 2 shows passage openings 11.1, 11.2 that are necessary for the connecting elements of connections 12.1, 12.2 on the flange regions arranged horizontally aligned on both sides of a vertical plane of symmetry.

Bearing block 5 in this case, and especially visible in FIG. 2, is designed as a bearing shell which, in an installation position may be open at the bottom for at least partial reception of bearing shell unit 4 with flange regions equipped with flange surfaces 10.1, 10.2. The inside chamber as the receiving chamber for the at least partial accommodation of bearing shell unit 4 may be surrounded by the bearing shell in a longitudinal direction and open toward the bottom 19. The lateral regions of bearing block 5 which are arranged on both sides of the plane of symmetry and when viewed in a circumferential direction around longitudinal axis L, at least partially surround bearing shell 4 may be equipped with guides 16.1, 16.2 that extend over at least a section of the extension of bearing block 5 in a longitudinal direction.

The connection between bearing shell unit 4 and bearing block 5 may occur via a connecting device having at least one tear-off element, in this case two connecting devices 13.1, 13.2, respectively having at least one connecting element in the embodiment of a tear-off element 14.1, 14.2 oriented in a longitudinal direction of bearing block 5. These may be arranged on both sides and symmetrical relative to the vertical plane of symmetry of bearing block 5 and thus also in direction of longitudinal axis L of coupling rod 2 in the neutral position, that is in the no-load and non-deflected position. The connection between bearing shell unit 4 and bearing block 5 can occur in such a way that, in their installation position, bearing shell unit 4 and bearing block 5 are braced against one another in the direction of tensile force. For this purpose, a tension stop, in this case tension stops 18.1, 18.2, are provided on bearing block 5 in the end region that is aligned with coupling rod 2. Such tension stops provide a contact surface which is facing away from coupling rod 2 on which bearing shell unit 4 rests. Bracing can be realized via tear-off elements 14.1, 14.2. These may include tear-off bolts which extend through a connecting region 17.1, 17.2 on the bearing shell unit 4 and the bearing block 5, in particular tension stops 18.1, 18.2 and secured with a nut on the side facing coupling rod 2. The individual connecting region 17.1, 17.2 can be arranged offset for this purpose relative to retainer 6, 7, preferably offset relative to same in the range of 90°. Other angle ranges are conceivable.

Under normal conditions, an initiation of a tensile force or impact force that was introduced into bearing shell unit 4 via coupling rod 2 can occur into bearing block 5 via tear-off elements 14.1, 14.2 until a predetermined dimension is reached and from said bearing block 5 via connections 12.1, 12.2 into carriage body 3.

When exceeding a predefined value of the force that is introduced into bearing shell unit 4, actuation of at least one tear-off element 14.1, 14.2 may occur, terminating connections 13.1, 13.2 between bearing shell unit 4 and bearing block 5. Tear-off elements 14.1, 14.2 tear off and bearing shell unit 4 can be moved on bearing block 5 relative to same. For this purpose, at least one guide may be provided on bearing block 5, in this case respectively one guide 15.1, 15.2 on each side of the vertical plane of symmetry. The functions of the spherical bearing of coupling rod 2 and its connection to carriage body 3 are in this case spatially remote from one another. In this case, the functions are assumed by separate components, the function of the spherical bearing is assumed by bearing shell unit 4 and the connection of the coupling rod via pivot pin 8 with same and the function of introducing the tensile- and impact force into carriage body 3 is assumed by bearing block 5.

During a complete interruption of the power train from coupling rod 2 to carriage body 3 through actuation or respectively tearing off of the tear-off elements 14.1, 14.2, bearing shell unit 4 is guided in a longitudinal direction along bearing block 5. For this purpose, bearing shell unit 4 has at least one guide region or one guide element 15.1, 15.2 for interaction with individual guide 16.1, 16.2 which extends in a longitudinal direction of bearing block 5. This guide region or respectively the individual guide element 15.1, 15.2 is arranged offset relative to retainer 6, 7, in the illustrated example preferably by approximately 90°. The configuration of the guide region coincides with the configuration of connection region 17.1, 17.2.

There are a multitude of possibilities in regard to the constructive design of guides 16.1, 16.2 and guide elements 15.1, 15.2. Individual guide 16.1, 16.2 preferably has only one degree of freedom that permits the movement in a longitudinal direction of bearing block 5. Individual guide 16.1, 16.2 is hereto characterized by several guide surfaces that can be oriented in and facing different directions. In the illustrated example, there is shown a guide surface 20.1, 20.2 limiting an upward movement of bearing shell unit 4 in a vertical direction with a directional component perpendicular relative to the longitudinal direction, a guide surface 21.1, 21.2 limiting a downward movement of bearing shell unit 4 in a vertical direction with a directional component perpendicular relative to the longitudinal direction and a guide surface 22.1, 22.2 limiting a movement in a width direction of the bearing shell unit in a horizontal direction with a directional component perpendicular relative to the longitudinal direction of the bearing block are provided. Viewed in cross section, these describe a C-profile. The guide surfaces, may be provided on both sides of the vertical plane of symmetry, together with guide elements 15.1, 15.2 that are guidable on said guide surfaces create a guide system on bearing shell unit 4. Guide elements 15.1, 15.2 can be designed as solid profile elements which, when viewed in a cross section, have a rectangular profile. They may be integral with bearing shell unit 4 and complementary to the guide. The meshing profiles of guide 16.1, 16.2 and guide element 15.1, 15.2 provide an interlocking connection between bearing block 5 and bearing shell unit 4 with a clearance fit and may be a tongue and groove connection or any other conceivable embodiment. Because of lower 21.1, 21.2 guide surface in a vertical direction, a continuance of bearing shell unit 4 in bearing block 5 over a predefined displacement distance of same relative to bearing block 5 in a longitudinal direction is a given in the event of an actuation. Additional guide surfaces 20.1, 20.2 and 22.1, 22.2 ensure that canting of bearing shell unit 4 in bearing block 5 is not possible and that in the event of actuation of the tear-off devices, bearing shell unit 4 can be guided securely in a longitudinal direction without dropping out of bearing block 5.

The length of guide 16.1, 16.2 on bearing block 5 may be selected in such a way that after actuation of tear-off elements 14.1, 14.2 a movement of bearing shell unit 4 relative to bearing block 5 in a longitudinal direction until such point that the maximum displacement distance is reached. Bearing shell unit 4 is free from complete separation from bearing block 5 and thus parts only partially from same as a result of which bearing shell unit 4 is still held in a vertical direction and width direction in bearing block 5 over a section of the extension.

Tear-off elements 14.1, 14.2 in this example are in the embodiment of tear-off bolts. The placement of the connection between bearing shell unit 4 and bearing block 5 can occur outside the guide region or respectively the guide elements on bearing shell unit 4, or as illustrate in the drawings in the region of guide elements 15.1, 15.2 or offset to same. In an exemplary embodiment, guide 16.1, 16.2 and guide element 15.1, 15.2, viewed in a longitudinal direction, are braced against one another via the tear-off bolts, so that a transfer of tensile force can occur via same onto the bearing block, and that moreover with an impact force of a predefined critical magnitude, an actuation of a separation occurs.

Figure 4B:
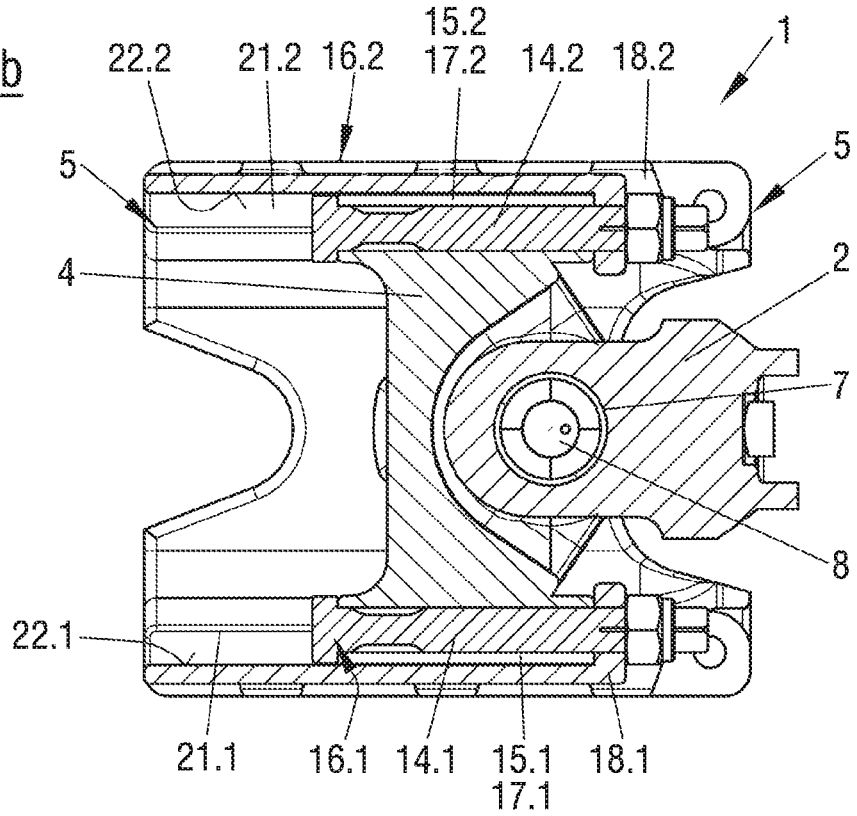
FIG. 4*b* shows a vertical cross section view through the embodiment shown in FIG. 1*b; and*
Figure 4C:
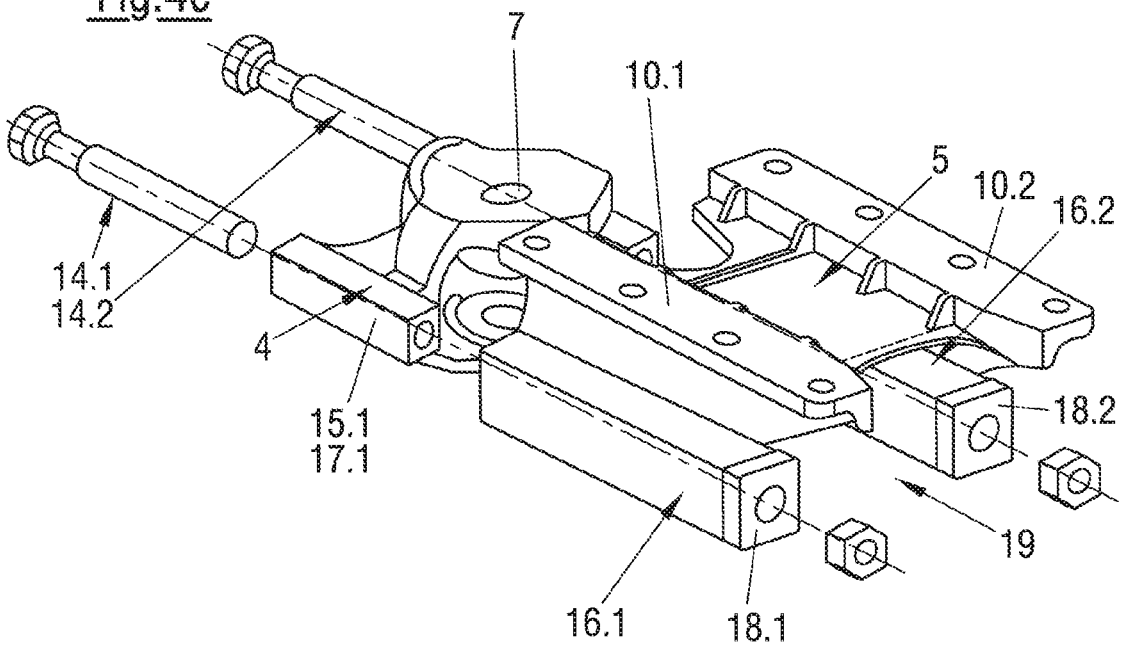
FIG. 4*c* shows an exploded view of the embodiment shown in FIG. 1*b*.

FIGS. 4*a* to 4*c* illustrate various views of an exemplary embodiment of bearing block assembly 1. FIG. 4*a* is a view in the direction of longitudinal axis L, as seen from the direction of the coupling rod, without the illustration of coupling rod 2 and pivot pin 8 mounted retainers 6, 7. Clearly shown is bearing block 5 that is designed as a bearing shell, open at the bottom with the flange surfaces. Bearing shell unit 4 is arranged in the region that is surrounded by bearing block 5. Guide elements 15.1, 15.2 are guided in guides 16.1, 16.2 and may be provided on both sides integral to bearing shell unit 4. The connection between bearing shell unit 4 and bearing block 5 may be provided via tear-off elements 14.1, 14.2.

FIG. 4*b* is a cross sectional view 4*b*-4*b* from FIG. 4*a*. Shown are hinging of pivot pin 8 in bearing shell unit 4 and bracing of same in a longitudinal direction relative to bearing block 5 by tear-off elements 12.1, 12.2. A tension stop is provided on bearing block 5 which may be located in the region of guide 16.1, 16.2 and can provide a contact surface for guide element 15 in a direction toward the coupling rod. Tension stop 18.1 or respectively 18.2 may be formed integral with bearing block 5.

FIG. 4*c* in an exploded view illustration clarifies the primary components of bearing block assembly 1.

In all embodiments, connecting regions 17.1, 17.2 may be provided on bearing shell unit 4 and guide regions 15.1, 15.2 are provided by a solid profile extending in a longitudinal direction and designed integrally on the bearing shell unit. The outside circumference provides guide surfaces for guiding on guide 16.1, 16.2 of bearing block 5 and through which tear-off elements 14.1, 14.2, extending in passage openings 23.1, 23.2, and bearing shell unit 4 are located connectively with bearing block 5 in the region of the full profile elements. Tear-off elements 14.1, 14.2 are guided through passage openings 22.1, 22.2 on tension stop 18.1, 18.2 and secured relative to same by nuts.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

COMPONENT IDENTIFICATION LISTING

1 Bearing block assembly
2 Coupling rod
3 Carriage body
4 Bearing shell unit
5 Bearing block
6 Retainer
7 Retainer
8 Pivot pin
9 Contact surface on carriage body
10 Flange surface
10.1, 10.2 Flange surface
11.1, 11.2 Passage openings
12 Connection between carriage body ad bearing block
13 Connection between bearing block unit and bearing block
14.1, 14.2 Tear-off element
15.1, 15.2 Guide region, guide element
16.1, 16.2 Guide
17.1, 17.2 Connecting region on bearing shell unit for connection with bearing block
18.1, 18.2 Tension stop
19 Receiving region for the at least partial accommodation of the bearing shell unit
20.1, 20.2 Guide surface
21.1, 21.2 Guide surface
22.1, 22.1 Guide surface
23.1, 23.2 Passage opening
24.1,24.2 Passage opening

What is claimed is:

1. A bearing block assembly for hinging a coupling rod to a carriage body of a track guided vehicle, comprising:

a flange for connecting the bearing block assembly to the carriage body;

a bearing shell unit connected at least indirectly with the flange, the bearing shell unit including two retainers being arranged in horizontal vertically offset planes and configured for accommodating a vertically progressing common pivot pin or for accommodating respectively one vertically progressing rotary pin that is accordingly allocated to the respective retainer;

a bearing block including the flange and an open bearing shell receiving region in at least a longitudinal direction, the open bearing shell receiving region configured for at least partial reception of the bearing shell unit;

at least one guide extending in the longitudinal direction over at least a section of an extension of the bearing block;

wherein the bearing shell unit is connected to the bearing block via at least one of at least one tear-off element and at least one shear-off element, the bearing shell unit being movably guided on the at least one guide on the bearing block in the longitudinal direction when at least one of the at least one tear-off element and the at least one shear-off element is actuated, thereby releasing the connection between the bearing shell unit and the bearing block;

wherein the bearing shell unit includes at least one guidance region or at least one guide element for interaction with the at least one guide that extends in the longitudinal direction of the bearing block, thereby forming a guide system; and wherein the connecting region and the guidance region on the bearing shell unit are formed by a solid profile element formed integral with the bearing shell unit extending in the longitudinal direction, wherein an outside circumference of the solid profile element includes a plurality of guide surfaces for guiding on the at least one guide of the bearing block, wherein the at least one tear-off element extends and the bearing shell unit is arranged in connection to the bearing block about the solid profile elements.

2. The bearing block assembly according to claim 1, wherein the bearing shell unit is connected with the bearing block via at least one tear-off element that is aligned in the longitudinal direction of the bearing block.

3. The bearing block assembly according to claim 1, wherein the flange includes at least one flange surface arranged at least partially in a horizontal plane and extending in the longitudinal direction and configured to connect with a plurality of complimentary contact surfaces on the carriage body.

4. The bearing block assembly according to claim 1, wherein at least one of the bearing shell unit and the bearing block are configures as a single component.

5. The bearing block assembly according to claim 1, wherein at least one of the bearing shell unit and the bearing block are a cast component.

6. The bearing block assembly according to claim 1, wherein the bearing shell unit includes at least one connecting region for connection with the bearing block, the at least one connecting region having at least one single tear-off element arranged therein.

7. The bearing block assembly according to claim 6, wherein at least one of the at least one connecting region, the at least one guidance region and the at least one guide element are angularly offset relative to one of the two retainers located in the bearing shell unit.

8. The bearing block assembly according to claim 7, wherein a plurality of connecting sections of the connecting region are formed by a plurality of guidance sections of the at least one guidance region.

9. The bearing block assembly according to claim 1, wherein the at least one guide on the bearing block includes at least one of a first guide surface, a second guide surface and a third guide surface, wherein the first guide surface limits an upward movement of the bearing shell unit in a vertical direction with a directional component perpendicular to the longitudinal direction, the second guide surface limits a downward movement of the bearing shell unit in the vertical direction with a directional component perpendicular to the longitudinal direction and the third guide surface limits a movement in a width direction of the bearing shell unit in a horizontal direction with a directional component perpendicular to the longitudinal direction of the bearing block.

10. The bearing block assembly according to claim 1, wherein the guide system is formed by a positive connection between the bearing block and the bearing shell unit, wherein the positive connection has a clearance fit and a degree of freedom in the longitudinal direction.

11. The bearing block assembly according to claim 1, wherein a length of the at least one guide on the bearing block is configured to prevent complete separation of the bearing shell unit from the bearing block after a maximum shift of the bearing shell unit relative to the bearing block in the longitudinal direction and actuation of at least one of the at least one tear-off element and the at least one shear-off element.

12. The bearing block assembly according to claim 1, wherein the bearing shell unit is braced with the bearing block with at least one of the at least one tear-off element and the at least one shear-off element.

13. The bearing block assembly according to claim 1, wherein the bearing block includes a tension stop formed integral with or connected to for support of the bearing shell unit when it is under a tensile stress, wherein the bearing shell unit is braced relative to the tension stop with at least one of the at least one tear-off element or the at least one shear-off element.

14. The bearing block assembly according to claim 1, wherein the at least one tear-off element is at least one tear off bolt or at least one rivet.

15. The bearing block assembly according to claim 1, wherein the at least one shear-off element is at least one bolt or at least one rivet.

16. The bearing block assembly according to claim 1, wherein at least one of the bearing shell unit and the bearing block are symmetrical about a vertical plane along the longitudinal direction.

* * * * *